United States Patent [19]

Becker

[11] 4,202,268

[45] May 13, 1980

[54] TRANSFER DRUM FOR PRINTING PRESSES WITH DEVICES FOR GRIPPING THE LEADING AND TRAILING EDGES OF A SHEET WHICH IS BEING IMPRINTED

[75] Inventor: Willi Becker, Bammental, Fed. Rep. of Germany

[73] Assignee: Heidelberger Druckmaschinen Aktiengesellschaft, Heidelberg, Fed. Rep. of Germany

[21] Appl. No.: 699,845

[22] Filed: Jun. 25, 1976

Related U.S. Application Data

[63] Continuation of Ser. No. 525,612, Nov. 20, 1974, abandoned.

[30] Foreign Application Priority Data

Nov. 22, 1973 [DE] Fed. Rep. of Germany ..... 2358223

[51] Int. Cl.[2] ..... B41F 13/44; B41F 21/04

[52] U.S. Cl. ..... 101/409; 101/232; 271/82; 271/277

[58] Field of Search ..... 271/276, 277, 82; 101/230–232, 407–410

[56] References Cited

U.S. PATENT DOCUMENTS

| | | | |
|---|---|---|---|
| 2,056,922 | 10/1936 | Gegenheimer | 101/410 |
| 2,599,776 | 6/1952 | Peyrebrune | 101/409 |
| 2,757,610 | 8/1956 | Gegenheimer et al. | 101/183 |
| 3,096,088 | 7/1963 | Young | 101/409 |
| 3,125,022 | 3/1964 | Reinhartz et al. | 101/410 |
| 3,151,552 | 10/1964 | Peyrebrune | 101/409 |
| 3,417,696 | 12/1968 | Kock et al. | 101/409 |
| 3,430,946 | 3/1969 | Siebke | 271/277 |
| 3,537,391 | 11/1970 | Mowry et al. | 101/183 |
| 3,654,861 | 4/1972 | Rudolph et al. | 101/409 |
| 3,796,154 | 3/1974 | Weisgerber | 101/409 |
| 3,829,084 | 8/1974 | Jurny | 271/277 |
| 3,865,362 | 2/1975 | Luffy et al. | 101/410 |
| 3,937,142 | 2/1976 | Cerny et al. | 101/409 |

*Primary Examiner*—William Piepaz
*Attorney, Agent, or Firm*—Herbert L. Lerner

[57] ABSTRACT

Transfer drum for printing presses through which a sheet to be imprinted passes, includes a shaft, a first and second row of sheet-supporting segments disposed in comb-like fashion along the periphery of the drum, devices for gripping, respectively, the trailing and leading edges of a sheet, one of the rows of segments being rotatably mounted on the shaft together with one of the gripping devices, and the other of the rows of segments being fixedly mounted on the shaft together with other of the gripping devices, the rows of segments being rotatable relative to one another, each of the gripping devices extending rigidly over the entire width of the drum and being secured to the respective row of segments in channels formed in the drum.

9 Claims, 11 Drawing Figures

Fig. 1
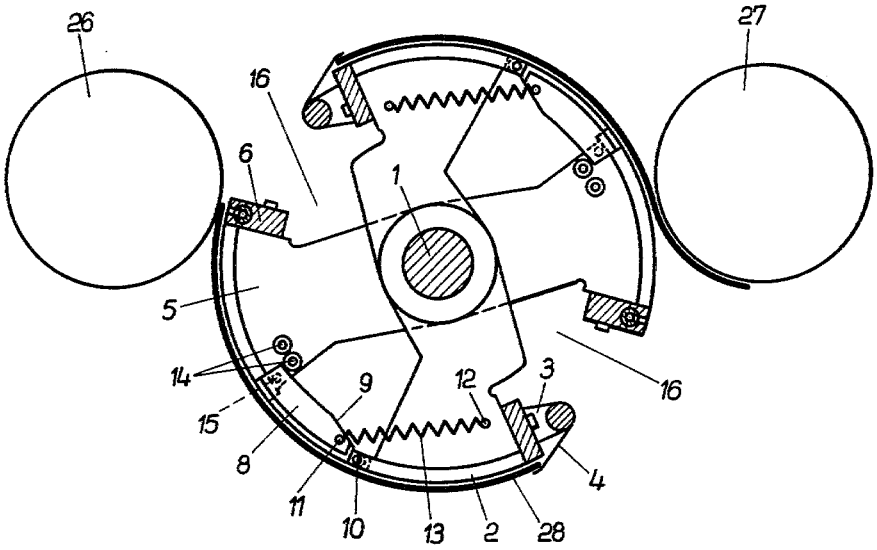
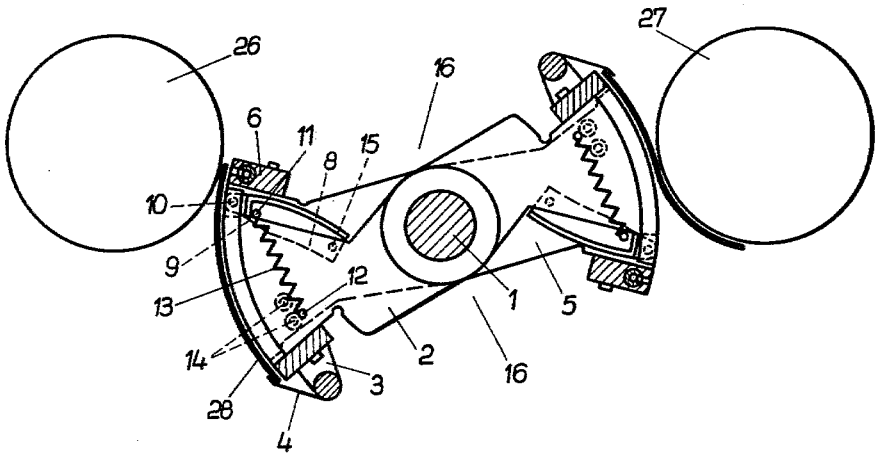
Fig. 2

Fig. 6
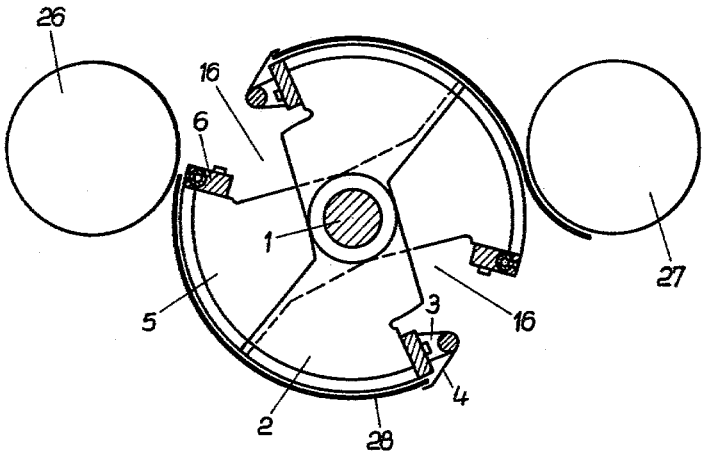
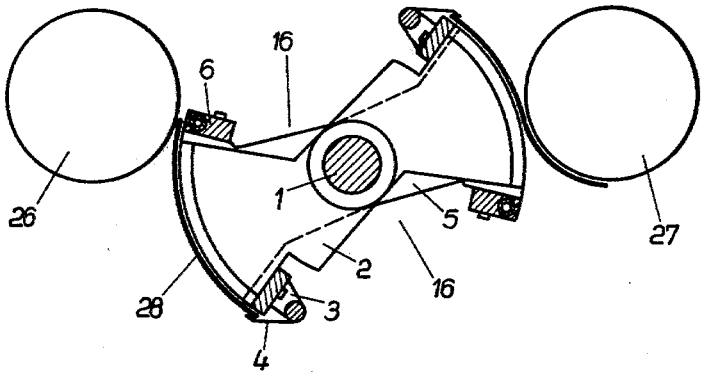
Fig. 7

Fig. 9
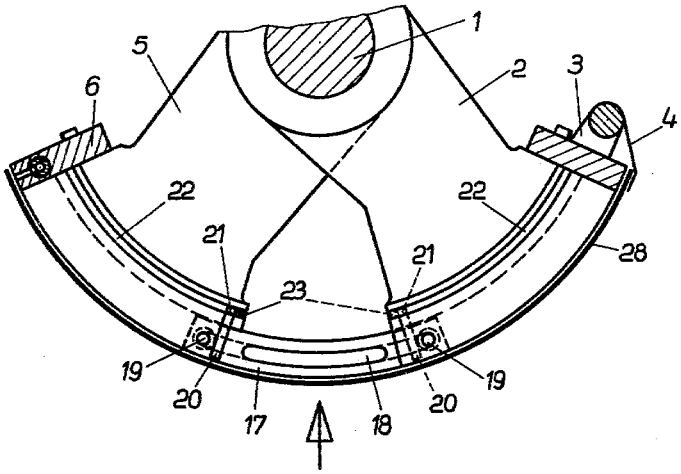
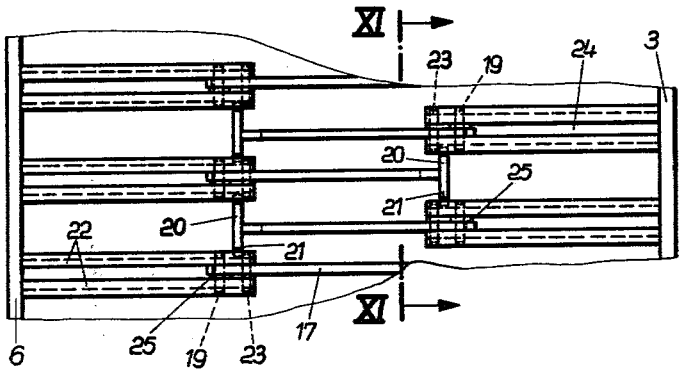
Fig. 10
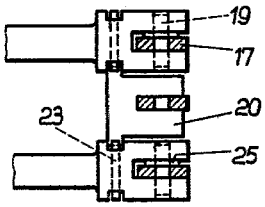
Fig. 11

TRANSFER DRUM FOR PRINTING PRESSES WITH DEVICES FOR GRIPPING THE LEADING AND TRAILING EDGES OF A SHEET WHICH IS BEING IMPRINTED

This is a continuation of application Ser. No. 525,612 filed Nov. 20, 1974, now abandoned.

The invention relates to a transfer drum for printing presses with devices for gripping the leading and trailing edges of a sheet that is being imprinted, at least one of the devices being adjustable.

In heretofore known constructions of this general type, a sheet is taken over at its leading edge by a transfer drum from a preceding transfer or impression cylinder. Thereafter, the sheet is seized at the trailing edge thereof by a suction or gripping device and transferred thereby to the next transfer or impression cylinder for imprinting the rear side thereof. In order to be able to work on various formats, either the device for gripping the leading edge of the sheet or the device for gripping the trailing edge thereof must be adjustable.

From German Pat. No. 1 611 241, sheet-guiding transfer cylinders for printing presses have become known, which are equipped with grippers for seizing the forward or leading edge of a sheet and with a device for seizing the rear or trailing edge of the sheet, the latter device being adjustable together with control members and connecting members between the stationary sheet-supporting segments.

In this heretofore known construction, it is not possible to attach a continuous suction bar, but rather, only individual suction heads that are spaced between the supporting plates. Due to these rather large spacings between the suction heads, the trailing edge of the sheet is not gripped along the entire width thereof. This can cause inaccurate positioning of the trailing edge of the sheet resulting in inaccuracies in registry when imprinting the reverse side of the sheet. Furthermore, the connecting and control members of the suckers pass through the stationary support plates which serve for supporting and carrying the paper sheet. The slots and opening required in the spokes of the heretofore known support plates cause weakening of these members and also limit the range of adjustment of the device. Furthermore, grooves must be provided for the grippers of the adjacent transfer or impression drums in the peripheral surfaces of the support plates, resulting in a decrease of the contact area of the sheet.

In German Pat. Nos. 2 227 151 and 2 228 671, there is described a device for seizing a paper sheet on a transfer cylinder as well a reversing mechanism for a device for tensioning the sheet, wherein gripper shafts extending therethrough are mounted at both ends thereof in end plates or on support arms.

Since no bracing or support is provided for the gripper shaft, however, between the bearing locations at both ends thereof, assurance of a rigid construction i.e. a construction resistant to bending, is not offered. Because of this condition, especially for wide types of machines, vibration of the gripper shaft can occur with consequent formation of inaccuracies in register. Furthermore, in both devices, the supporting segments are penetrated by tubes or, as in German Pat. No. 2 227 151, the support plates are penetrated by plugs or pins, weakening the stability or strength of the transfer drum. In the last-mentioned device, furthermore, the range of adjustment for different formats is limited by the length of the perforations or openings formed in the support plates.

German Petty Pat. Gbm No. 6 949 816 discloses a sheet-transfer cylinder with a gripping mechanism for seizing the forward or leading edge of the sheet for firmly holding paper sheets in printing presses having several printing mechanisms or units. In this heretofore known construction, the adjustment or shift to various different formats is achieved by rotation of the support plates which form the peripheral surface of the sheet-transfer cylinder, together with rotation of the device for seizing the rear or trailing edge of the sheet in peripheral direction towards the stationary device for seizing the forward or leading edge of the sheet, which does not vary its position relative to the axis.

For adjustment purposes, arcuately shaped slots are provided in the support plates, through which the control and connecting members of the device for gripping the forward or leading edge of the sheet extend. These elongated slots weaken the individual support plates which form the transfer cylinder so that the latter may become non-circular or out of round. Because of the penetrations made in the individual support plates, the gripper shaft and gripper bar cannot be made as strong as usual and cannot be supported across the full width of the machine. This can cause vibrations and bending of parts resulting in inaccuracies of registry, no only when imprinting the rear sides of sheets but also when imprinting single-side sheets. Moreover, grooves must be provided in the outer surfaces of the support plates for the grippers of the preceding sheet transfer or impression cylinder, the contact area of the paper sheet being thereby considerably reduced. Furthermore, the range of adjustment for the various formats is limited by the length of the arcuate elongated slots formed in the support plates.

In the sheet guiding mechanism for sheet transfer cylinders in multicolor sheet-fed rotary printing presses according to German Pat. No. 1 561 101, the setting or adjustment devices for gripping the leading or trailing edge of the sheet are dispensed with. Instead thereof, flexible pressure strips are disposed on segments, which are displaceable in peripheral and in axial direction, the individual segments overlapping with the flexible pressure strips so that the sheet is continuously pressed against the impression cylinder during its travel.

In this heretofore known construction, the forward or leading edge of the sheet remains in the closed gripper during the pick-up of the rear edge of the sheet only in the case of the smallest format, whereas with all larger formats, the sheet is pressed against the preceding printing cylinder by the flexible pressure strips only until the rear or trailing edge of the sheet is picked up. This can cause inaccuracies in registry. Furthermore, the pressure strips can damage the imprint, since not all printed work has areas that are free of printing, to which the flexible pressure strips can be applied. Furthermore, the guidance of large sheet becomes unreliable when there is a great difference between the minimum and maximum format.

It is accordingly an object of this invention to provide a transfer drum for printing presses which can handle sheets of various formats, and wherein devices for gripping the leading and trailing edges of the sheet have an especially stable construction and are secured to the sheet-supporting segments in order thereby to avoid inaccuracies in registry due to vibrations and bending.

With the foregoing and other objects in view, there is provided, in accordance with the invention, a transfer drum for printing presses through which a sheet to be imprinted passes, comprising a shaft, a first and second row of sheet-supporting segments disposed in comb-like fashion along the periphery of the drum, devices for gripping, respectively, the trailing and leading edges of a sheet, one of the rows of segments being rotatably mounted on the shaft together with one of the gripping devices, and the other of the rows of segments being fixedly mounted on the shaft together with the other of the gripping devices, the rows of segments being rotatable relative to one another, each of the gripping devices extending rigidly over the entire width of the drum and being secured to the respective row of segments in channels formed in the drum.

In accordance with another feature of the invention, the first row of segments together with the trailing edge-gripping device are rotatably mounted on the shaft, and the second row of segments together with the leading edge-gripping device are fixedly mounted on the shaft.

In accordance with a further feature of the invention, depending upon which one of the rows of sheet-supporting segments is fixed to the shaft, the gripping device of the other of the rows of segments is adjustable.

In order that the minimal format to be processed, depending upon the class of format, can be larger or much smaller than half the maximal format, there are provided, in accordance with an added feature of the invention, spanning members mounted at one of the two rows of sheet-supporting segments for spanning a gap that is formed between both of the rows of segments and that varies in size in accordance with given format adjustments, and control means for automatically adjusting the spanning members.

It is thereby assured that, after each format adjustment, the supported sheet is in contact with the sheet-supporting segments.

With the simplified construction of the sheet transfer drum of the invention, the individual sheet-supporting segments are not penetrated by connecting or control elements of the sheet-gripping devices as in the case of prior art constructions. For this reason, the sheet-supporting segments can be of rugged construction without any weakenings, such as slots or elongated holes, so that the adjustment range of the devices for gripping the leading and trailing edges of the sheet is not limited by the length of the slots and elongated holes.

Since all sheet-supporting segments for every format adjustment or installation are located within the sheet length between the leading and trailing edges of the sheet, the devices for gripping the leading and trailing edges of the sheet can be constructed so as to be resistant to bending across the entire width of the transfer drum and secured to the sheet-supporting segments within the channels of the drum.

The device for gripping the rear or trailing edge of the sheet may be constructed as a suction bar extending across the transfer drum and provided with several suction openings or locations spaced close to one another independently of the spacing between the segments. Because of the stable or rugged construction of the sheet-supporting segments and the bending-resistant devices for gripping the leading and trailing edges of the sheet, inaccuracies in registry due to vibrations and bending of machine members are eliminated both for single-side printing as well as double-side or perfector printing.

Furthermore, due to the relatively simple structure of the invention, the manufacturing and assembly time are considerably diminished, and the costs thereby correspondingly reduced.

Although the invention is illustrated and described herein as embodied in transfer drum for printing presses with devices for gripping the leading and trailing edges of a sheet which is being imprinted, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which:

FIG. 1 is a side view, partly in section, of the transfer drum, according to the invention, adjusted for a large format, the drum being constructed so that the minimal format to be processed is considerably smaller than half the size of the maximal format;

FIG. 2 is a view, similar to that of FIG. 1, of the transfer drum adjusted for a small format;

FIG. 6 is a reduced view similar to that of FIG. 1 of another embodiment of the transfer drum wherein the minimal format to be processed is larger than half the size of the maximal format, the illustrated transfer drum being adjusted for a large format;

FIG. 7 is a view, similar to that of FIG. 6, of the transfer drum of FIG. 6 adjusted for a small format;

FIG. 9 is a fragmentary side view, partly in section, of yet another embodiment of the transfer drum of the invention, adjusted for a large format;

FIG. 10 is a plan view of FIG. 9 as seen in the direction of the associated arrow; and FIG. 11 is a cross-sectional view of FIG. 10, taken along the line XI—XI in the direction of the arrows.

Figure 3:
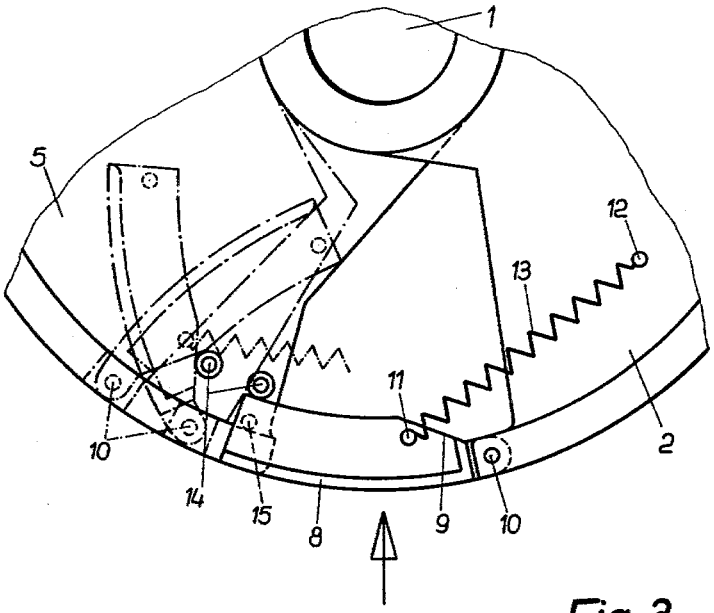
FIG. 3 is a fragmentary, enlarged view of FIG. 1 showing a hinged or pivotable configuration of the bridges thereof.
Figure 4:
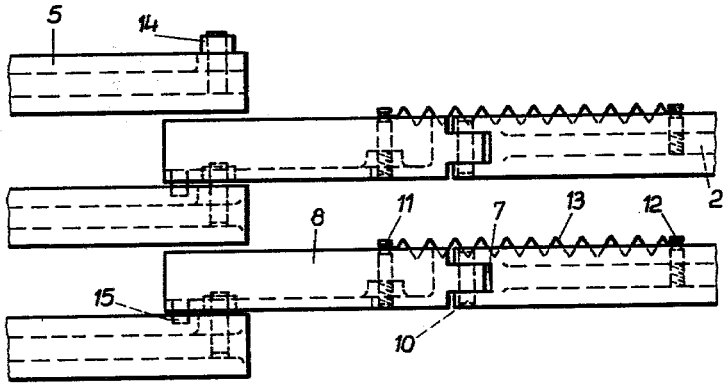
FIG. 4 is a fragmentary plan view of FIG. 3 as viewed in the direction of the associated arrow and showing the bridges in pivoted-away position.
Figure 5:
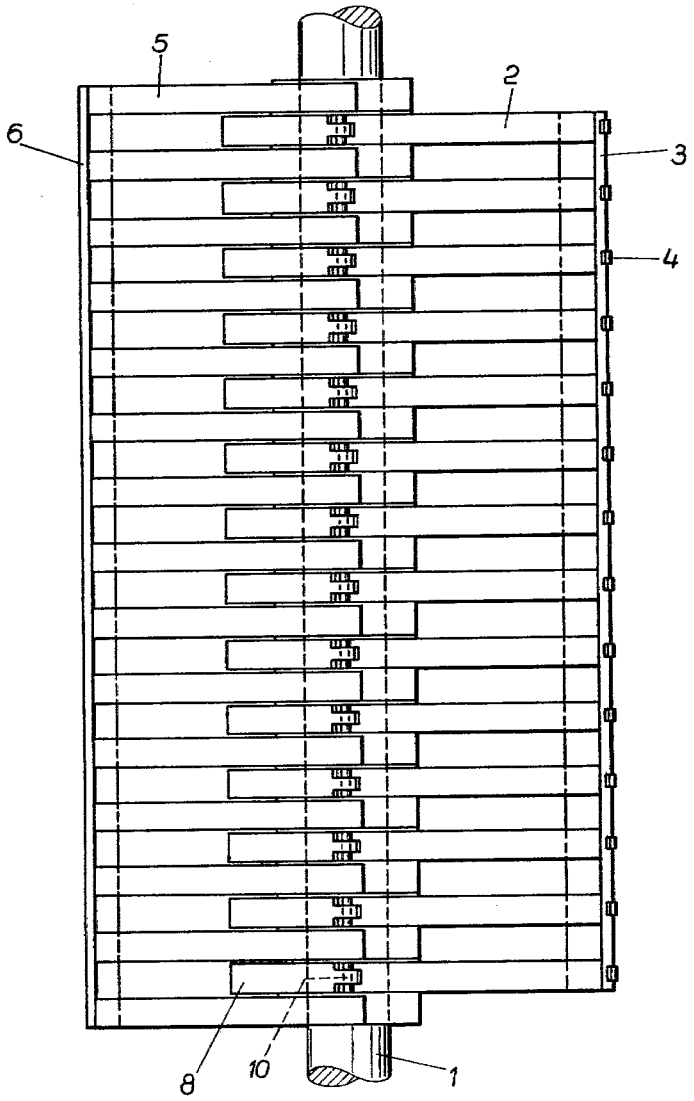
FIG. 5 is a complete axial view of the transfer drum of FIG. 1 with the bridges pivoted away.

Referring now to the drawing and first, particularly to FIGS. 1 to 5 thereof, there is shown secured on a shaft 1, a row of sheet-supporting elements or segments 2, at the end of which there is disposed a conventional device 3 for seizing the forward or leading edge of a sheet 28 by means of grippers 4. The device 3 is secured laterally to the sheet-supporting segments 2, extends over the entire width of the drum and is of rigid construction that is resistant to bending along the entire length thereof. A second row of sheet-supporting segments 5 with a device 6 for gripping the rear or trailing edge of the sheet 28 is rotatably mounted on the same shaft 1 and disposed axially displaced or offset from the first row of sheet-supporting segments 2, as shown in FIG. 4, for example, so that both rows of sheet-supporting segments 2, 5 are slideable comb-like one within the other. The device 6 for gripping the rear or trailing edge of the sheet 28 is also regidly constructed so as to be resistant to bending, for example, as a suction bar, and is secured in a drum channel 16 along the entire width of the drum to the sheet-supporting segments 5.

In order to install or adjust to different formats at the rear or trailing edge of the sheet, the rotatable row of sheet-supporting segments 5 can be adjusted or shifted in peripheral direction, by non-illustrated conventional means. By reversing the manner in which the two rows of sheet-supporting segments 2 and 5 are fastened to the shaft 1, the adjustment for different formats can be effected with the segment row 2 at the forward edge of the sheet.

When adjusting to a large format of the format class thereof, wherein the minimal format is much smaller than half the maximal format, an intermediate space is formed, which is filled in by spanning or bridging members 8 (FIG. 1), 17 (FIG. 9) which, when adjusting to a small format of this format class, automatically swing or travel inwardly.

Bearing slots 7 are provided in the sheet-supporting segments 2. Bridges 8 with beveled or inclined surfaces 9 are pivotally mounted on bearing pins 10 within the slots 7. Between pins 11 and 12, tension springs 13 are connected, the pins 11 being secured to the bridges 8, while the pins 12 are fastened to the stationary sheet-supporting segments 2. The tension springs 13 draw the bridges 8 by means of the pins 11 and 12 against rollers 14 that are mounted on the rotatable sheet-supporting segments 5. When the device 6 for gripping the rear or trailing edge of the sheet is adjusted, the bridges 8 initially travel in peripheral direction over the rollers 14 and then swing inwardly when the bevels 9 engage the rollers 14 and are guided thereon. The rollers 14 are matched with the beveled or cam surfaces 9 and so disposed that the bridges 8 swing inwardly only after both rows of sheet-supporting segments 2 and 5 at the ends thereof are already introduced comb-like and meshing one within the other, so that no gaps in the paper contact can occur. At the ends of the bridges 8 blocking pins 15 are secured which prevent unintentional outward swinging of the bridges 8.

In the embodiment of the invention illustrated in FIGS. 9 to 11, as in the aforedescribed embodiments of FIGS. 1 to 5, two rows of sheet-supporting segments 2 and 5 are disposed on a shaft 1. Further, as aforedescribed with respect to the embodiment of FIGS. 1 to 5, rigid, bending-resistant devices 3, 6 for gripping the leading and trailing edges of a sheet 28 are fastened to the sheet-supporting segments 2 and 5, respectively. Moreover, in the outer surface of each sheet-supporting segment 2, 5 of both rows of segments, slots 24 are formed wherein yokes 17 slideable in peripheral direction of the drum are disposed. The yokes 17 are formed with slots 18 and are guided on one side by guide pins 19 which extend through the slots 18 of the yokes 17 and are secured to the sheet-supporting segments 2, 5. At the other side of the yokes 17, entrainer members 20 are disposed and provided with nose-like projections 21. The projections 21 and the yokes 17, as well, are guided in grooves 22, which are formed laterally in the sheet-supporting segments 2, 5 of both rows of segments.

Depending upon the adjustment or positioning of the devices 3, 6 for gripping the leading or trailing edges of a sheet, the yokes 17 are pushed by either one or the other device into grooves 24 formed in the outer surface of the segments 2, 5 when brought into engagement with the entrainer members 20, or they are drawn out of the grooves 24 by the entrainer pin 23 through the projections 21 of the entrainer member 20. To effect engagement of the entrainer pins 23 with the projections 21 of the entrainer member 20, the entrainer pins 23 are disposed at the end of each sheet-supporting segment 2, 5 and extend through the latter into the lateral grooves 22, wherein the projections 21 of the entrainer members 20 are guided. In the open space between the yokes 17 and the grooves 24, springs washers or plates 25 are provided on guide pins 19 and bias the yokes 17 toward the one side of the groove 24, and simultaneously act as a brake against automatic adjustment or shifting during operation of the printing machine.

Figure 8:
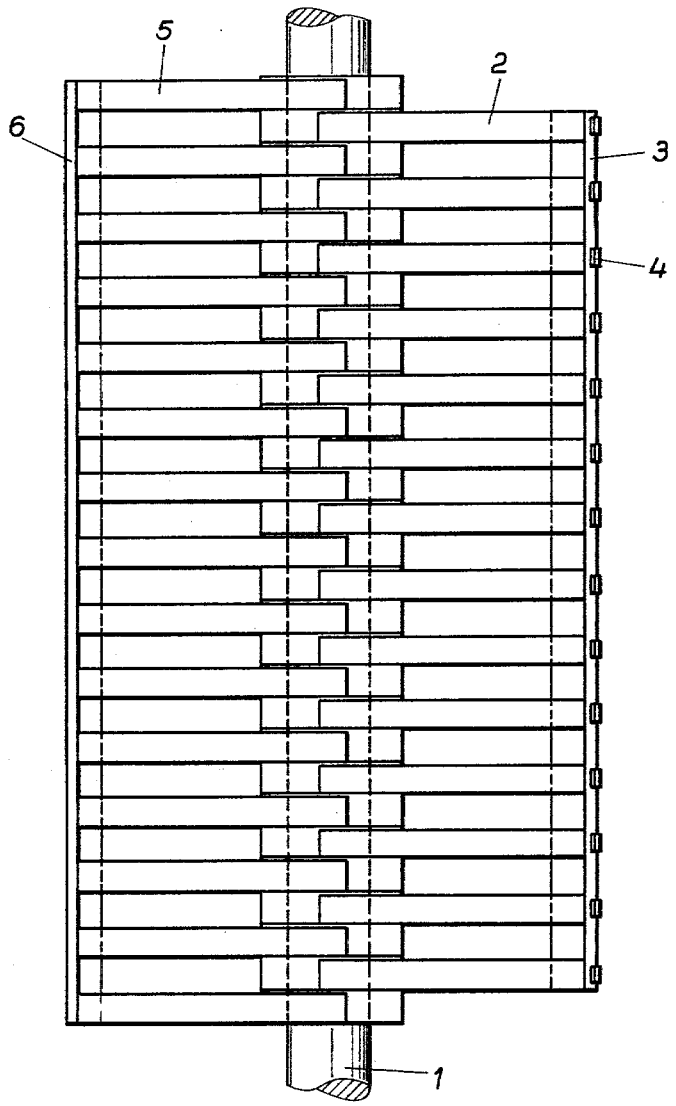
FIG. 8 is a complete axial view, like that of FIG. 5, of the transfer drum of FIG. 6.

For printing machines with a format class wherein the minimal format is larger than half of the maximal format, the bridge members 8 or 17 can be omitted because the length of the sheet-supporting segments 2 and 5 is so chosen that the segments 2 and 5 mesh comb-like in any setting or installation. An embodiment of the invention in such a format class is illustrated in FIGS. 6 to 8.

Because of the simplified construction of the transfer drum according to the invention, channels 16 have been formed in the drum between the devices 3 and 6 for gripping the leading and trailing edges, respectively, of a sheet so that, for any format setting or adjustment, through-shafts and bearings of the sheet gripping devices of the preceding or succeeding transfer or impression cylinders 26, 27 which feed or transfer the sheets 28, can dip into the peripheral path of the transfer drum. For this reason, no cut-outs, such as slots, for example, have to be provided in the outer surfaces of the sheet-supporting segments 2 and 5, for the sheet gripping devices of the preceding or succeeding transfer or impression cylinders 26 or 27.

I claim:

1. Transfer drum for printing presses through which a sheet to be imprinted passes, comprising a shaft for rotatably mounting the transfer drum, a first and a second row of sheet-supporting elements disposed in comb-like fashion along the periphery of the drum, devices for gripping, respectively, the trailing and leading edges of a sheet, one of said rows of sheet-supporting elements being rotatably mounted directly on said shaft together with one of said gripping devices, and the other of said rows of sheet-supporting elements together with the other of said gripping devices being fixedly mounted directly on said shaft, said row of sheet-supporting elements together with said gripping devices, respectively, being rotatable as respective units relative to one another, each of said gripping devices comprising a gripper bar rigidly extending with a continuous sheet-supporting surface over substantially the entire width of the drum and being secured to each of the sheet-supporting elements of the respective row thereof in channels formed in said drum, said gripping devices being stationary at all times relative to the respective row of sheet-supporting elements.

2. Transfer drum according to claim 1 wherein said first row of sheet-supporting elements together with said trailing edge-gripping device are rotatably mounted on said shaft, and said second row of sheet-supporting elements together with said leading edge-gripping device are fixedly mounted on said shaft.

3. Transfer drum according to claim 1 wherein, depending upon which one of said rows of sheet-supporting elements is fixed to the shaft, the gripping device associated with the other of said rows of sheet-supporting elements is adjustable.

4. Transfer drum according to claim 1 wherein said sheet-supporting elements comprise a pair of rows of substantially diametrically opposing segments.

5. Transfer drum for printing presses through which a sheet to be imprinted passes, comprising a shaft, a first and a second row of sheet-supporting elements disposed in comb-like fashion along the periphery of the drum, devices for gripping, respectively, the trailing and leading edges of a sheet, one of said rows of sheet-supporting elements being rotatably mounted on said shaft together with one of said gripping devices, and the other of said rows of sheet-supporting elements together with the other of said gripping devices being fixedly mounted on said shaft, said rows of sheet-supporting elements being rotatable relative to one another, each of said gripping devices comprising a gripper bar extending rigidly over the entire width of the drum and being secured to the respective row of sheet-supporting elements in channels formed in said drum, said gripping devices being stationary relative to the respective row of sheet-supporting elements, and including spanning members mounted at one of the two rows of sheet-supporting elements for spanning a gap that is formed between both of said rows of sheet-supporting elements and that varies in size in accordance with given format adjustments, said spanning members having means for automatically adjusting the position thereof independently of and relative to said sheet-supporting elements in accordance with the size of said gap.

6. Transfer drum according to claim 5 wherein said gripping devices are secured respectively at an end of the respective rows of sheet-supported elements spaced from the gap spanned by said spanning members.

7. Transfer drum for printing presses through which a sheet to be imprinted passes, comprising a shaft, a first and a second row of sheet-supporting elements disposed in comb-like fashion along the periphery of the drum, devices for gripping, respectively, the trailing and leading edges of a sheet, one of said rows of sheet-supporting elements being rotatably mounted on said shaft together with one of said gripping devices, and the other of said rows of sheet-supporting elements being fixedly mounted on said shaft together with the other of said gripping devices, said rows of sheet-supporting elements being rotatable relative to one another, each of said gripping devices extending rigidly over the entire width of the drum and being secured to the respective row of sheet-supporting elements in channels formed in said drum, and spanning members being mounted at one of the two rows of sheet-supporting elements for spanning a gap that is formed between both of said rows of sheet-supporting elements and that varies in size in accordance with given format adjustments, said spanning members having means for automatically adjusting the position thereof in accordance with the size of said gap, said spanning members being constructed as yokes respectively formed with yoke slots and having at one end thereof respective entrainer members formed with projections, said projections being received in respective lateral grooves formed in said sheet-supporting elements for guiding said yokes at said one end thereof, guide pins fastened in said sheet-supporting elements and extending through and cooperating with said yoke slots and spring plate means mounted on said guide pins and disposed in the space between adjacent yokes and in grooves formed in the surface of the transfer drum for displacing said yokes in peripheral direction, said spring plate means biasing said yokes toward one side of said last-mentioned grooves.

8. Transfer drum for printing presses through which a sheet to be imprinted passes, comprising a shaft, a first and a second row of sheet-supporting elements disposed in comb-like fashion along the periphery of the drum, devices for gripping, respectively, the trailing and leading edges of a sheet, one of said rows of sheet-supporting elements being rotatably mounted on said shaft together with one of said gripping devices, and the other of said rows of sheet-supporting elements being fixedly mounted on said shaft together with the other of said gripping devices, said rows of sheet-supporting elements being rotatable relative to one another, each of said gripping devices extending rigidly over the entire width of the drum and being secured to the respective row of sheet-supporting elements in channels formed in said drum, and spanning members being mounted at one of the two rows of sheet-supporting elements for spanning a gap that is formed between both of said rows of sheet-supporting elements and that varies in size in accordance with given format adjustments, said spanning members having means for automatically adjusting the position thereof in accordance with the size of said gap, said spanning members being constructed as bridges, having substantially the same width as that of said sheet-supporting elements and are formed with beveled surface portions at the radially inner side thereof, said fixedly mounted sheet-supporting elements being formed with bearing slots, bearing pin means fastened to said fixedly mounted sheet-supporting elements at said bearing slots, respectively, and pivotally securing said bridges in said bearing slots, respectively, roller means mounted on said rotatable sheet-supporting elements, tension spring means connected to said bridges and urging said bridges into engagement with said roller means, the radially inner sides of said bridges cooperating with said roller means.

9. Transfer drum according to claim 8 including blocking pins secured at an end of said pivotable bridges and cooperating with the surfaces of said rotatably mounted sheet-supporting elements to additionally limit the swing of said pivotable bridges.

* * * * *